United States Patent [19]

Klein

[11] Patent Number: 4,753,269

[45] Date of Patent: Jun. 28, 1988

[54] HYDRAULIC LATCHING APPARATUS FOR A CONTROL SYSTEM

[75] Inventor: Michael L. Klein, Newhall, Calif.

[73] Assignee: HR Textron, Inc., Valencia, Calif.

[21] Appl. No.: 27,757

[22] Filed: Mar. 19, 1987

[51] Int. Cl.[4] ..... F15B 13/044; F15B 20/00

[52] U.S. Cl. ..... 137/596; 91/445; 91/450; 91/464

[58] Field of Search ..... 91/445, 450, 464, 509, 91/510; 137/596

[56] References Cited

U.S. PATENT DOCUMENTS 3,552,433 1/1971 Mason ..... 137/596 X 3,570,516 3/1971 Mason ..... 137/625.6 X

*Primary Examiner*—Gerald A. Michalsky

*Attorney, Agent, or Firm*—Nilsson, Robbins, Dalgarn, Berliner, Carson & Wurst

[57] ABSTRACT

A system for hydraulically detecting the seizure of a control valve in a hydraulic servo valve system wherein a hydraulic signal generated responsive to the control valve seizure is utilized to translate a bypass valve from its operational position to its bypass position and simultaneously to provide a hydraulic signal for maintaining the bypass valve in its bypassed position.

6 Claims, 1 Drawing Sheet

HYDRAULIC LATCHING APPARATUS FOR A CONTROL SYSTEM

FIELD OF THE INVENTION

This invention relates generally to fluid-handling systems and more particularly to apparatus for use in such systems which is adapted to overcome errors which may occur from seizure of a control valve to the wall of the chamber within which it normally translates.

BACKGROUND OF THE INVENTION

It is well known in the prior art that wherein the flow of hydraulic fluid is controlled by a mechanism that failure sometimes occurs through the result of control valve seizure. When such occurs the flow of hydraulic fluid to a load or to a load-control mechanism is inconsistent with the command signals applied to the system in the first instance. Such improper load control can, under some circumstances, cause a failure of an entire mission dependent upon the control system. Various apparatus have been developed to overcome such spool seizure by way of utilization of bypass valves and the like. In all instances known to applicant, the seizure-developed signal is momentary in nature and may permit the system to continue to operate once a spool valve seizure has occurred. The prior art known to applicant is shown in U.S. Pat. Nos. 2,389,274; 2,940,428; 2,941,515; 3,213,886; 3,253,613; 3,338,138; 3,406,721; 3,426,792; 3,552,433; 3,555,969; 3,561,322; 3,570,516; 3,693,506; 3,702,575; 3,826,174; 3,908,515; 3,951,162; 4,009,642; 4,041,842; 4,138,088; 4,333,387; 4,394,999; 4,456,031; 4,555,976; 4,570,672.

SUMMARY OF THE INVENTION

A hydraulic seizure-detection and hydraulic latching apparatus wherein a hydraulic signal is generated responsive to the seizure of a control valve and is applied to cause a first valve means to translate from an operating position toward a latched position. When the first valve means so translates, a source of hydraulic fluid under pressure is applied to the first valve to maintain it in the latched position to thereby effectively eliminate the control valve from the system.

DETAILED DESCRIPTION

Figure 1:
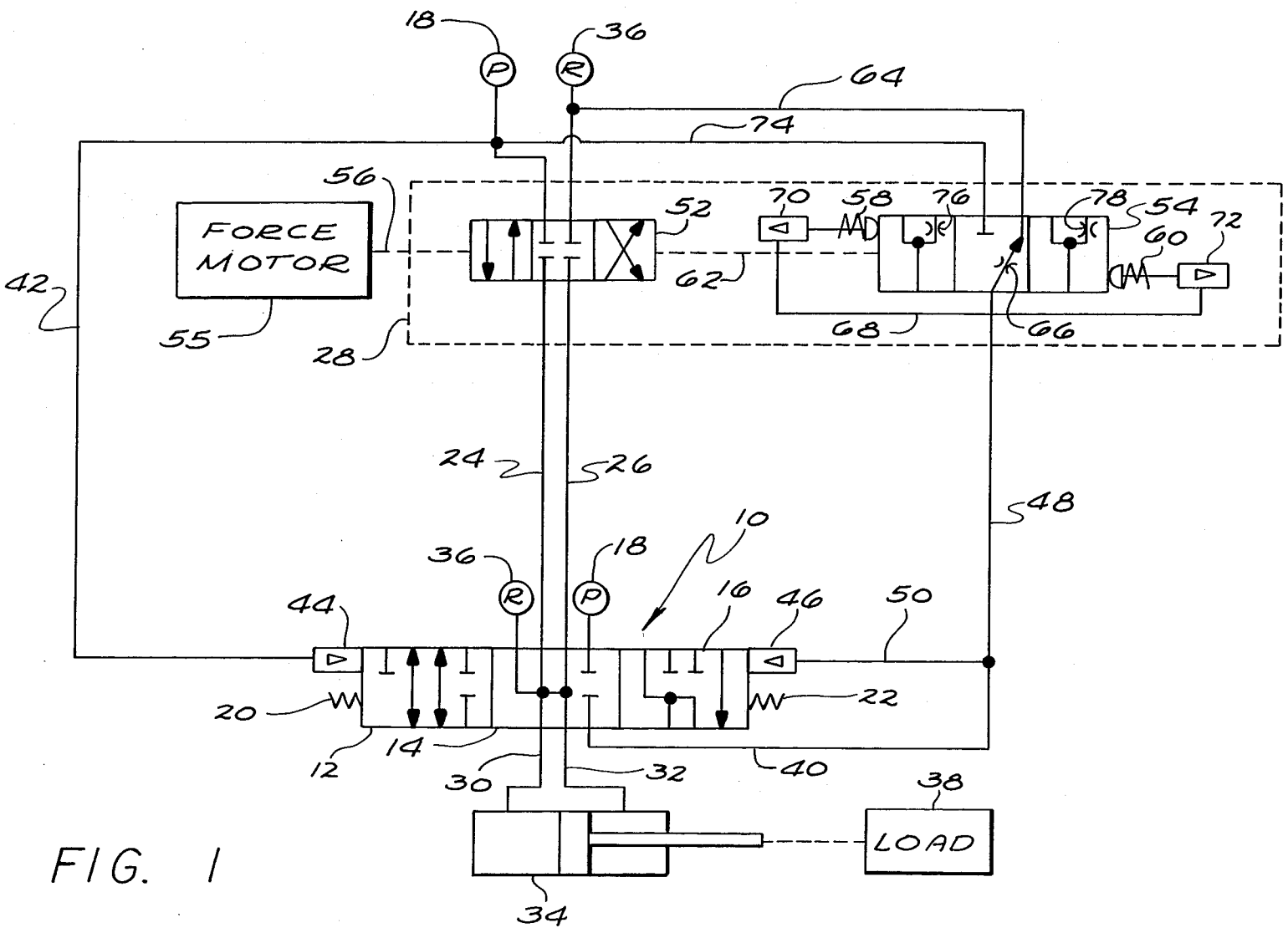
FIG. 1 is a schematic diagram illustrating an apparatus constructed in accordance with the principles of the present invention.

The present invention is useful in any system where high reliability control of a load is desired. The system is particularly adapted for utilization in aircraft hydraulic flight control systems particularly of the type wherein redundant dual concentric servo control valves are incorporated. Such systems are well known in the art at the present time, and such systems including those wherein spool seizure detection is incorporated are well known. Applicant therefor specifically makes reference to and incorporates by such reference the disclosures contained in U.S. Pat. Nos. 2,941,515; 3,257,911; 3,338,138; 3,552,433; 3,406,721 and 3,426,792.

As will become apparent from a consideration of the disclosures incorporated herein by reference, it has been customary in the prior art to incorporate a bypass mechanism within the system to nullify the actuator which is being controlled by the seized control valve. However, since the signal generated as a result of the seized control valve may be only momentary, the control valve may again assume operation of the system if the seizure of the control valve disappears. Obviously, such is not desirable since a seizure could again occur. In the past, latching mechanisms have been utilized when seizure occurs as is shown in U.S. Pat. No. 3,552,433. Such systems, however, are complex and difficult to implement and operate. A comparator for comparing two hydraulic signals and providing an output signal if the differential pressure therebetween is of sufficient magnitude and then latching in a limit position in response thereto has been utilized as is shown in the patent Richard K. Mason U.S. Pat. No. 3,570,516 the disclosure of which is also incorporated herein by reference.

The present invention provides a simple straightforward hydraulic latching of a bypass valve which disables the seized control valve immediately upon the occurrence of even a momentary signal (beyond simple system pressure variations) occurring.

That is, once the momentary signal indicating spool valve seizure occurs, the bypass valve translates and thereafter operates continuously independent of changes in the state of the spool seizure signal.

As will become apparent to those skilled in the art from the disclosures incorporated herein by reference, there are numerous ways of implementing mechanically and hydraulically the system of the present invention. As a result, a simple schematic sketch illustrating the principles of the present invention has been provided for simplicity of illustration and clarity of description. Referring now to the sketch, there is illustrated a three-position bypass valve 10. The first position is indicated by the sector 12, the second position by the sector 14 and the third position by the sector 16. When the bypass valve is in the second position as illustrated in the sketch, the system is inactive and quiescent in the absence of hydraulic fluid under pressure from the source 18. Under these conditions, the valve 10 is spring loaded to its second position by the springs illustrated at 20 and 22. In the quiescent position, the passageways 24 and 26 leading from the control valve 28 to the bypass valve 10, as well as the passageways 30 and 32 leading from the bypass valve 10 to the actuator 34, are shunted together through the sector 14 of the bypass valve 10 to system return 36. As a result, any attempt to control the load 38 would be completely ineffective. In addition, system pressure 18 is blocked from application to the passageway 40.

When operation of the system is initiated, hydraulic fluid under pressure becomes available at the source 18 thereof. Under these circumstances, the hydraulic fluid is applied through passageway 42 to the valve 10 operator 44 thereby causing the valve 10 to translate to its position whereby the first sector 12 occupies the position of sector 14 as shown in the drawing. It will be noted that the second valve operator 46 is connected through the passageway 48 to return 36. The force generated through the first operator 44 is substantially greater than the spring force of the spring 22.

When the bypass valve 10 is in the position with the first sector in operable position, it will be noted that system return 36 is blocked. System pressure 18 is blocked. But there is a direct interconnection between the passageways 24 and 30 and also between the passageways 26 and 32. Therefore, in this position the actuator 34 may position the load 38 responsive to the application of fluid under commands from the control valve 28.

If, on the other hand, system pressure is applied to the second valve operator 46 (as will be described more fully hereinafter), then the valve 10 is caused to translate from the position as shown in FIG. 1 such that the third sector 16 occupies the position illustrated for the second sector 14 in the drawing. Under these circumstances, it will be noted that system return 36 is connected directly to the passageways 30 and 32 and the passageways 30 and 32 are interconnected together thus effectively short-circuiting the actuator 34 and connecting it to return. In addition thereto, system pressure 18 is connected directly to the passageway 40 which in turn is connected by the passageway 50 directly to the second valve operator 46. The forces generated by the second valve operator 46 are substantially greater than the forces generated through the first valve operator 44 and will thereby cause the bypass valve 10 to be hydraulically latched into the position such that the control valve 28 will be rendered ineffective to position the actuator 34 and thereby control the load 38.

Turning now to the control valve 28, as above indicated it is preferably a dual concentric servo control valve. Such a control valve includes a primary spool 52 and a secondary spool 54, one movable within the other. In accordance with the schematic as shown, in the preferable of the present invention the primary spool 52 is utilized to control the application system pressure 18 and system return 36 to the actuator 34 responsive signals applied to the primary spool from a source thereof such as the force motor 55. The interconnection between the force motor 55 and the primary spool 52 is shown by the dashed line 56.

Preferably the spool 54 is used only to detect seizure of the primary spool 52. Thus the spool 54 is a spring centered spool positioned within a bore within a housing while the primary spool 52 translates within a central bore provided in the spool 54. The springs 58 and 60 maintain the spool 54 centrally positioned in the absence of a spool seizure. The dashed line 62 is of the mechanical interconnection between primary and secondary spools 52 and 54, that the ability of spool 52 to translate within the spring centered spool 54.

As will be obvious to those skilled in the art, when the primary spool 52 translates either to the left or to the right, pressure or return is applied to the passageways 24 and 26 which (because the bypass valve 10 is translated to the right) are immediately passed through the passageways 30 and 32 respectively to the actuator 34. Thus, when the primary spool 52 moves from left to right as viewed in the drawing, pressure is applied to the passageway 24 and return is applied to the passageway 26. Alternatively, when the primary spool 52 is translated from the right toward the left, pressure is applied to the passageway 26 and return to the passageway 24. Such translation of the primary spool 52 is under control of the force motor 55.

While the system is operating normally, that is, in the absence of a spool seizure, system return is applied through the passageway 64 and through the center section of the secondary spool 54 which includes an orifice 66 to the bypass valve 10 second operator 46. The orifice 66 functions to preclude momentary fluctuations in system return pressure from causing the valve 10 to operate. It should also be noted that system return is also applied by way of the passageway 68 to the secondary spool operators 70 and 72 to maintain them in a deactivated position.

So long as there is no spool jamming or seizure, that is, so long as the spool 52 translates within the spool 54, the system operates normally to control the load 38 in response to signals applied to the control valve 28 by the force motor 55. Should, however, the primary spool 52 jam or seize with regard to the secondary spool 54, then the two spools 52 and 54 will move together in response to signals from the force motor 55. When the movement of the secondary spool 54 occurs, one or the other of the outer sections of the secondary spool 54 will be moved into such a position that system pressure 18 will be applied through the passageway 74 and along the passageway 48 to the second valve operator 46 causing the bypass valve 10 to move towards the left as viewed in the drawing. As will be noted, orifices 76 and 78 are provided to prevent undue fluctuation in system return when system pressure is momentarily applied to the passageway 48. Since valve operator 46 applies a substantially greater force to the valve 10 than does the operator 44, the bypass valve 10 will immediately translate from the right to the left so that the third sector 16 occupies a position as shown currently occupied by 14. Under these circumstances as above pointed out, return is connected across the actuator 34 and system pressure is applied through the passageways 40 and 50 so as to maintain a constant application thereof to the second valve operator 46 of the bypass valve 10 thereby hydraulically latching the bypass valve 10 in the bypass position. So long as the system is maintained in an operative position, that is, the supply of system pressure is not removed, the bypass valve 10 will be latched in its bypass position. During the same period of time, the force motor 55 may continue to function responsive to input signals applied to it thereby causing the primary and secondary spools of a control valve 28 to continue to move. Thus, the initial activating signal indicating spool seizure may disappear and reappear on a momentary basis without in any way affecting the position of the bypass valve 10. At the same time, system pressure is applied by way of passageways 48 and 68 to the secondary spool operators 70 and 72 causing them to remove the application of the springs 58 and 60 to the secondary spool 54. Such function removes the spring load from the secondary spool 54 thus removing in turn the additional spring load from the force motor 55.

As above pointed out, the manner of implementation of the system as above described and illustrated in the drawing may take many different forms without deviating from the invention. As has been described, there is provided a very simple hydraulic bypass valve which latches by application of system pressure to the bypass valve in response to receipt of a hydraulic signal sensing a spool seizure or jam of the primary control valve.

What is claimed is:

1. A hydraulic seizure detection and hydraulic latching apparatus for use in control systems having dual servo control valves comprising:

(A) a source of hydraulic fluid under pressure;

(B) hydraulic signal generating means for providing at least a momentary hydraulic pressure signal from said source responsive to seizure of one of said servo control valves and including a primary and a secondary spool valve in said servo control valve, one of said spool valves moving relative to the other in the absence of spool seizure and said spool valve moving together upon the occurrence of spool seizure;

(C) first valve means translatable between operating and latched positions;

(D) means including said secondary valve means for applying said hydraulic pressure signal to said first valve means to translate said first valve means from said operating position toward said latched position; and (E) means operable responsive to movement of said first valve means toward said latched position for applying hydraulic fluid from said source to said first valve means to maintain said first valve means in said latched position.

2. The apparatus as defined in claim 1 wherein said first valve means includes a first spool valve reciprocally disposed within a bore and defining a chamber therein having first and second ports, said first port being connected to said signal generating means and said second port being connected to said source, said second port being blocked by said first spool valve in the absence of said signal.

3. The apparatus as defined in claim 1 wherein said secondary spool valve includes means for applying said source of hydraulic fluid to said first valve means upon the occurrence of spool seizure and which further includes spring means for centering said secondary spool valve and maintaining it in said centered position in the absence of spool seizure.

4. The apparatus as defined in claim 3 which further includes operator means responsive to the hydraulic fluid from said source when said first valve is in said latched position to deactivate said spring means thereby allowing said primary and secondary spools to freely move together.

5. The apparatus as defined in claim 4 wherein said means for applying hydraulic fluid to latch said first valve means includes said first valve means.

6. The apparatus as defined in claim 5 wherein said secondary spool further defines restriction orifice means.

* * * * *